US010266186B2

(12) United States Patent
Beck et al.

(10) Patent No.: US 10,266,186 B2
(45) Date of Patent: Apr. 23, 2019

(54) BEARING BLOCK FOR ARTICULATING A COUPLING ROD TO A CAR BODY OF A TRACK-GUIDED VEHICLE

(71) Applicant: Voith Patent GmbH, Heidenheim (DE)

(72) Inventors: Thomas Beck, Braunschweig (DE); Arthur Kontetzki, Salzgitter (DE); Kay-Uwe Kolshorn, Wolfenbuttel (DE); Hauke Schleisieck, Cremlingen (DE)

(73) Assignee: Voith Patent GmbH, Heidenheim (DE)

( * ) Notice: Subject to any disclaimer, the term of this patent is extended or adjusted under 35 U.S.C. 154(b) by 436 days.

(21) Appl. No.: 15/025,642

(22) PCT Filed: Sep. 16, 2014

(86) PCT No.: PCT/EP2014/069694

§ 371 (c)(1),
(2) Date: May 11, 2016

(87) PCT Pub. No.: WO2015/049104

PCT Pub. Date: Apr. 9, 2015

(65) Prior Publication Data

US 2016/0272224 A1 Sep. 22, 2016

(30) Foreign Application Priority Data

Oct. 1, 2013 (DE) ..... 10 2013 110 888

(51) Int. Cl.
*B61G 7/10* (2006.01)

(52) U.S. Cl.
CPC ..... *B61G 7/10* (2013.01)

(58) Field of Classification Search
CPC ..... B61G 7/10; B61G 5/02; B61G 1/40
See application file for complete search history.

(56) References Cited

U.S. PATENT DOCUMENTS 5,509,548 A * 4/1996 Kreher ..... B61G 7/06 213/100 W
8,596,475 B2 * 12/2013 Kobert ..... B61G 5/04 213/178

(Continued)

FOREIGN PATENT DOCUMENTS

DE 1 068 294 B 11/1959
DE 10 68 294 B 11/1959

(Continued)

OTHER PUBLICATIONS

Gerhard Pahl, Wolfgang Beitz (authors): Inducement for applying the Differential Construction Method: adjustment option in: Engineering Design—Methods and Applications Third Edition, Berlin: Springer Verlag (Springer Publishing Company), 1993, p. 371, Chapter 7.5 entitled Design Guidelines—Differential Construction Method ISBN 3-540-56194-3.3.3 [Textbook], 3 pages.

*Primary Examiner* — Jason C Smith
(74) *Attorney, Agent, or Firm* — Cesari and McKenna, LLP

(57) ABSTRACT

The present invention relates to a bearing block for articulating a coupling rod to a car body of a track-guided vehicle, particularly a railway vehicle. A modular design is provided so as to be able to easily and yet effectively adapt the bearing block to different applications. To this end, the bearing block comprises a first crosspiece having a bearing shell situated in a first horizontal plane as well as a second crosspiece having a bearing shell situated in a second horizontal plane. The two bearing shells each have a respective mount for a vertically extending (common) pivot bolt or for a pivot pin allocated to the respective bearing shell. The modular design of the bearing block is particularly realized by the first and (Continued)

Figure 1:
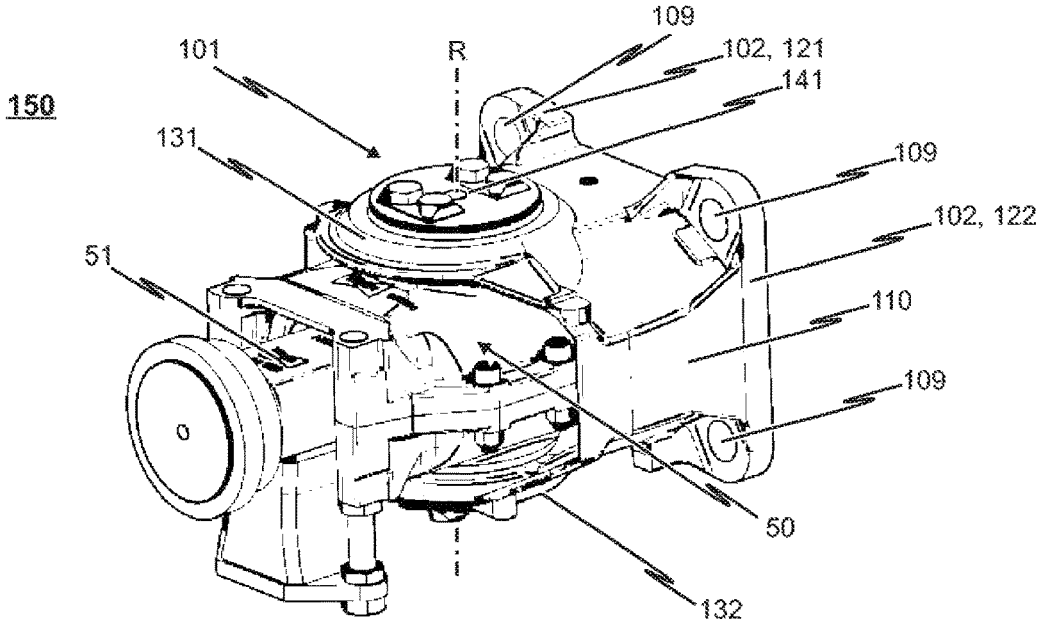

second crosspiece being implemented as separate structural components independently connectable to the car body of the track-guided vehicle.

20 Claims, 5 Drawing Sheets

(56) References Cited

U.S. PATENT DOCUMENTS

| | | | | |
|---|---|---|---|---|
| 9,527,517 | B2 * | 12/2016 | Westman | B61G 7/00 |
| 2007/0187350 | A1 * | 8/2007 | Kontetzki | B61G 7/00<br>213/75 R |
| 2009/0151595 | A1 | 6/2009 | Kontetzki | |
| 2016/0221590 | A1 * | 8/2016 | Kontetzki | B61G 7/06 |
| 2016/0272224 | A1 * | 9/2016 | Beck | B61G 7/10 |
| 2018/0154912 | A1 * | 6/2018 | Kontetzki | B61G 9/24 |

FOREIGN PATENT DOCUMENTS

| | | | | |
|---|---|---|---|---|
| DE | 198 14 166 | A1 | 10/1999 | |
| DE | 100 21 967 | A1 | 11/2001 | |
| DE | 20 2004 014 532 | U1 | 3/2006 | |
| DE | 20 2012 103206 | U1 | 9/2012 | |
| DE | 20 2012 103 206 | U1 | 11/2012 | |
| DE | 20 2013 005 377 | U1 | 8/2013 | |
| EP | 1 719 684 | A1 | 11/2006 | |
| EP | 1 925 523 | A1 | 5/2008 | |
| EP | 1925523 | A1 * | 5/2008 | B61D 3/10 |
| EP | 2 522 560 | A1 | 11/2012 | |
| EP | 2700556 | A1 * | 2/2014 | B61G 5/02 |
| WO | WO 2007/057072 | A1 | 5/2007 | |
| WO | WO 2013/185510 | A1 | 12/2013 | |

* cited by examiner (Stand der Technik)

(Stand der Technik)

BEARING BLOCK FOR ARTICULATING A COUPLING ROD TO A CAR BODY OF A TRACK-GUIDED VEHICLE

CROSS REFERENCE TO RELATED APPLICATIONS

This application is the National Stage of International Application No. PCT/EP2014/069694, filed on Sep. 16, 2014, which claims priority to German Application No. 10 2013 110 888.1, filed on Oct. 1, 2013. The contents of both applications are hereby incorporated by reference in their entirety.

The invention relates to a bearing block for articulating a coupling rod to a car body of a track-guided vehicle, particularly a railway vehicle.

In railway vehicle technology, a bearing block usually serves to connect a coupling rod to the car body of a railway vehicle so as to be pivotable in a horizontal plane. So that the coupling rod can also realize pivoting motions relative to the railcar body, necessary for example when a multi-member block train travels through curves, the linkage realized with the bearing block is usually implemented so as to enable horizontal and vertical outward pivoting as well as an axial rotation of the coupling rod relative to the car body.

It is further known that when a coupling rod is rigidly mounted by means of a bearing block, impacts and vibrations occurring for example during coupling or upon braking can result in damage to the vehicle and/or the coupling arrangement itself. In order to prevent such damage, it is necessary to limit the transmission of impacts, vibrations and the like to the greatest degree possible. This is preferably realized by providing a drawgear having elastic damping means to absorb such impacts transmitted in the flow of force through the coupling rod. Such a drawgear is frequently integrated into the linkage of the coupling rod to the car body; i.e. in the bearing block provided for the purpose. The drawgear is designed to route tractive and compressive forces up to a defined magnitude through the bearing block to the vehicle undercarriage in an elastically cushioning manner. The aim is to absorb energy by means of an elastic deforming of the damping means allocated to the drawgear and thus prevent excessive stress on the bearing block and particularly the vehicle undercarriage.

FIG. 1 shows a perspective view of a known prior art coupling linkage 150 of a central buffer coupling for railway vehicles. The representation in FIG. 2 shows a side sectional view of the coupling linkage 150 according to FIG. 1.

A drawgear 50 comprising a total of three spring elements 52.1, 52.2, 52.3 is in-tegrated into the conventional coupling linkage 150 shown. These spring elements 52.1, 52.2, 52.3 are designed so as to absorb tractive and impact forces up to a defined magnitude and to conduct forces exceeding the given magnitude through the bearing block 101 to the vehicle undercarriage.

Figure 2:
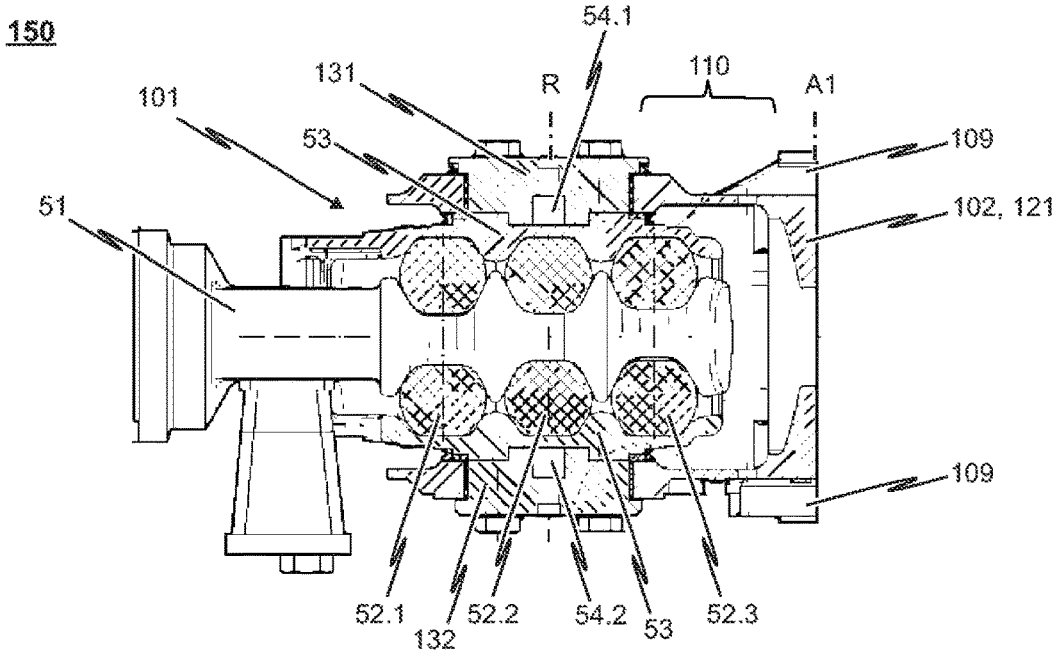
Figure 3A:
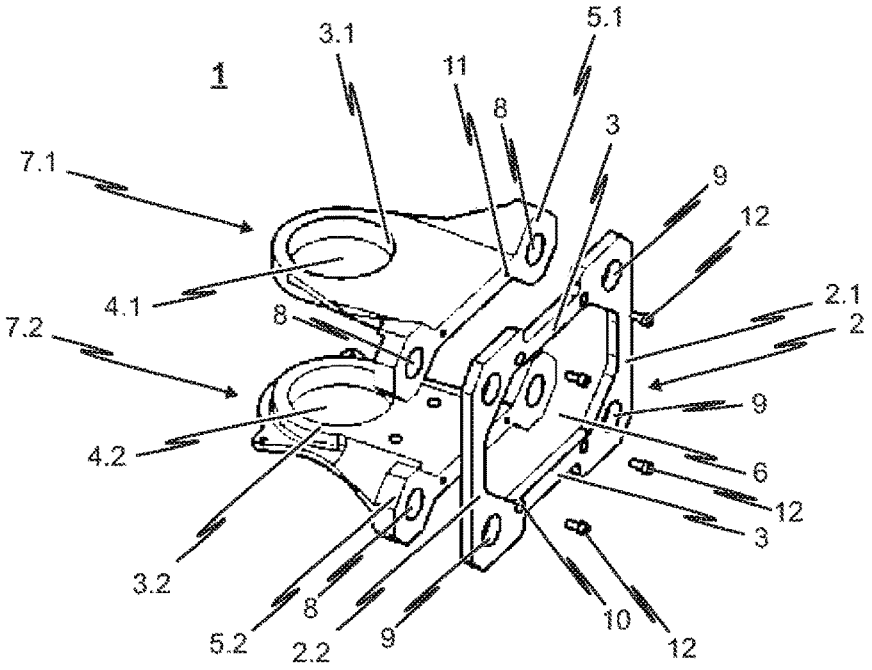
Figure 3B:
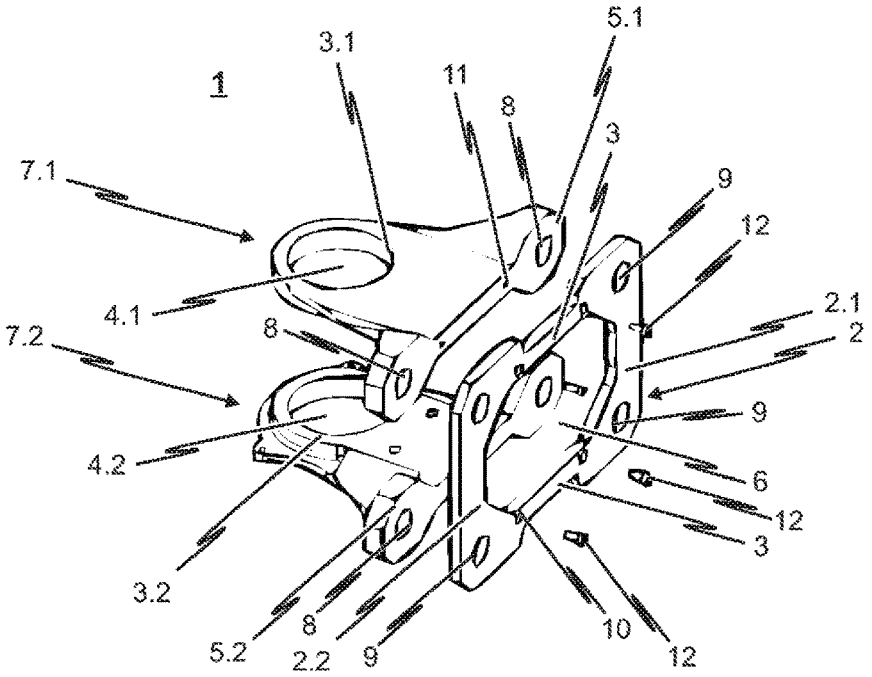
Figure 3C:
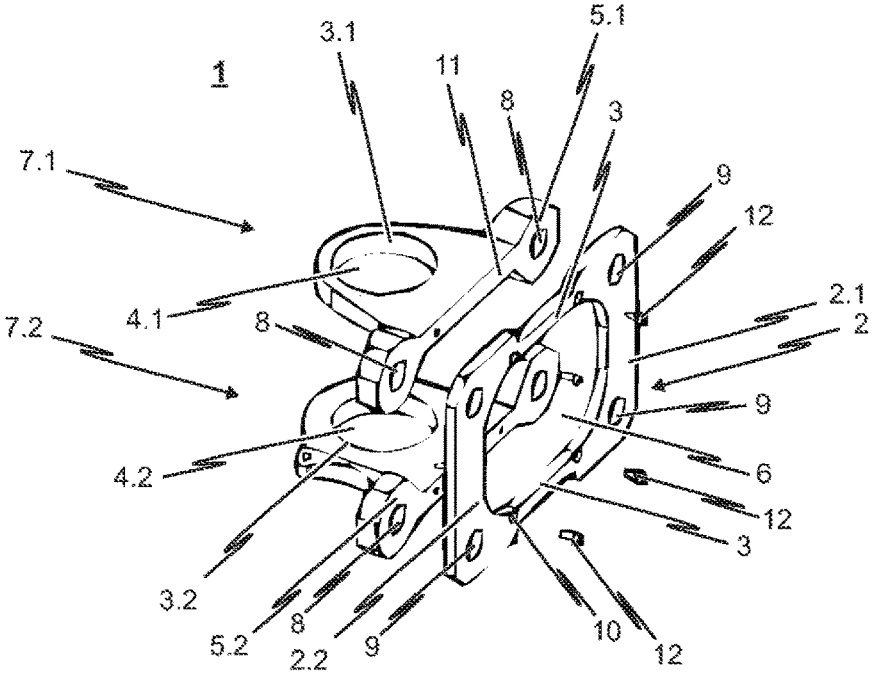
Figure 3D:
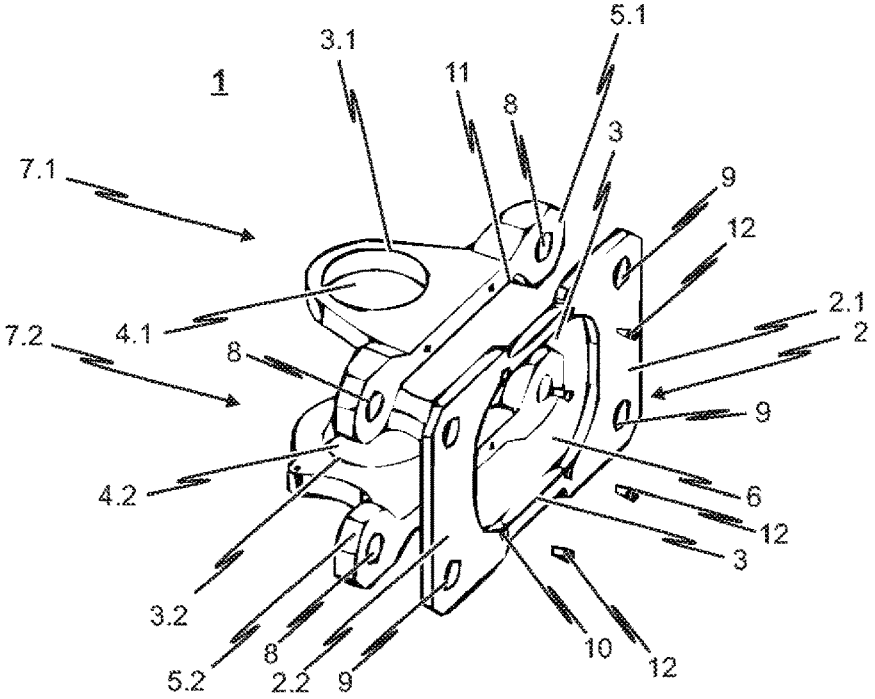
Figure 3E:
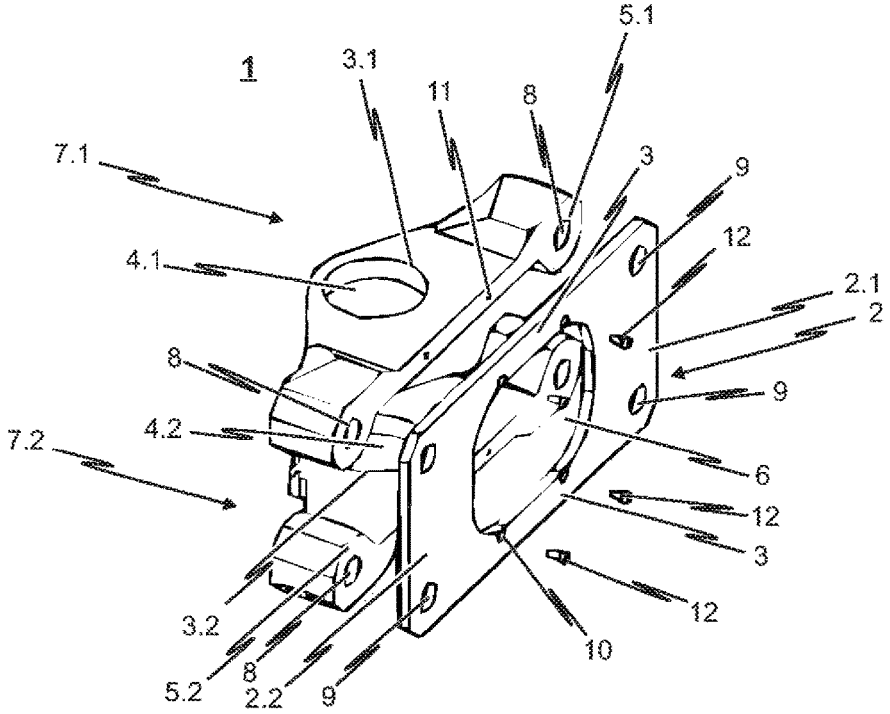

The coupling linkage 150 shown in FIGS. 1 and 2 encompasses the rear part of a coupling arrangement and serves to articulate in horizontally pivotable manner the coupling rod of a central buffer coupling to a (not explicitly depicted in the drawings) mounting plate of a railcar body via the bearing block 101.

Since the drawgear 50 solution known from the prior art configured in the form of damping means (here: elastomer spring mechanism) is accommodated within the bearing block 101, the bearing block 101 necessarily needs to exhibit a configuration which is adapted to the drawgear 50 (elastomer spring mechanism). Particularly needing to be ensured is specific relative motion between the bearing block 101 and the drawgear 50 articulated via the bearing shells 131, 132 of the bearing block 101 so as to be pivotable in a horizontal plane. In this respect, the overall length of the drawgear 50 as well as the damping behavior of said drawgear 50 determines the dimensions and particularly the length of the bearing block 101.

It can be noted from the depictions in FIGS. 1 and 2 that the bearing block 101 used in this conventional coupling linkage 150 has a cage or housing structure 110 via which the bearing shells 131, 132 of the bearing are connected to a vertically extending flange 102. In particular, in the conventional embodiment of the bearing block 101, the flange 102 is not situated in the same vertical plane through which the axis of rotation R defined by the bearing shells 131, 132 runs. Instead, vertical flange plane A1 is situated at a distance from the vertical axis of rotation R defined by the bearing shells 131, 132 in the direction of the car body (see FIG. 2).

As can especially be noted from the representation in FIG. 2, it is necessary in the conventional solution for the vertical flange plane A1 to be horizontally distanced from the vertical axis of rotation R defined by the bearing shells 131, 132. This distancing is necessary so that the drawgear 50 accommodated in the housing 53 can move toward the car body relative the bearing block 101 upon compressive load so as to thus be able to regeneratively dampen compressive forces. The horizontal distancing of the vertical flange plane A1 from the vertical axis of rotation R, and thus the length of the cage/housing structure 110, is thereby determined by the overall length and the damping behavior of the drawgear 50.

It is in particular evident that the cage/housing structure 110 of the bearing block 101 needs to be designed dependent on the damping characteristic and the overall length of the drawgear 50 accommodated in the bearing block 101. For example, when a drawgear 50 having more than three spring elements 52.1 to 52.3 is to be used, the housing 53 of the drawgear 50 is lengthened such that there is a greater horizontal distance between the vertical axis of rotation R defined by the bearing shells 131, 132 and vertical flange plane A1.

Because the functional principle and the structural design of the drawgear 50 accommodated in the bearing block 101 are not uniform and are selected as a function of the respective application, a great many bearing block variants need to be provided, which increases production costs.

The present invention is thus based on the task of specifying a solution enabling considerably more flexible use of a bearing block, including that with many different types of drawgears.

This task is solved by the subject matter of independent claim 1. Advantageous further developments are indicated in the dependent claims.

Accordingly, a bearing block is proposed which comprises a first crosspiece having a bearing shell situated in a first horizontal plane as well as a second crosspiece having a bearing shell situated in a second horizontal plane distanced from the first horizontal plane. The crosspieces in particular constitute transverse supports or similar structural elements. The bearing shells of the crosspieces each have a respective mount for a common vertically extending pivot bolt or for a pivot pin allocated to the respective bearing shell.

In contrast to the conventional solutions known from the prior art, the inventive bearing block is however not of single-piece design; instead, it is provided for the first and second crosspiece to be implemented as separate structural components independently connectable to the car body of the track-guided vehicle.

The advantages able to be achieved with the inventive solution are obvious: Because the bearing block consists of combinable individual parts, it is possible to select the vertical distance of the crosspieces individually and application-specific such that the individual parts of the bearing block, particularly the crosspieces of the bearing block, can accommodate drawgears of different design.

In one preferential further development of the invention, a baseplate formed separately from the crosspieces which comprises at least one flange region connectable to the car body of the track-guided vehicle is provided additionally to the two crosspieces. It is thus conceivable for the first and second crosspiece of the bearing block to be preferably detachably connected to the baseplate, and thus by means of the baseplate to the car body, independently of one another.

The solution according to the invention is not, however, limited to embodiments in which the two crosspieces of the bearing block can be pre-mounted by way of a baseplate. Instead of a baseplate, it is in fact also conceivable for so-called spacers to be provided which are preferably realized as separate components from the two crosspieces. Said spacers are preferably detachably connectable to the two crosspieces such that the crosspieces are spaced at a vertical distance from one another after the spacers being connected. This can in fact also be realized when only one single spacer is provided.

Corresponding mounts are preferably provided in the crosspieces to receive at least one area of the spacer. In one preferential realization, these mounts are provided at the lateral edge region of the respective crosspiece. Conceivable as a mount is in particular a groove or a channel-like track to position the spacer relative to the crosspiece in defined manner. However, other embodiments are also conceivable in this context for the mounts formed in the respective crosspieces.

One particularly preferential realization of the latter embodiment of the inventive bearing block makes use of two spacers which when mounted; i.e. when connected to the two crosspieces, are spaced apart from each other horizontally. The vertical extension of these two spacers then defines the distance between the first horizontal plane, in which the bearing shell of the first crosspiece is situated, and the second horizontal plane, in which the bearing shell of the second crosspiece is situated. It is thus evident that simply by replacing the spacers, the distance between the first and second horizontal plane, and thus the potential applications of the bearing block, can be varied.

According to a further aspect, the invention relates to a coupling linkage for the articulated connecting of a coupling rod to a railcar body, particularly to a railcar body of a multi-member track-guided vehicle, wherein the coupling linkage comprises a bearing block of the above-described type connected to the car body and a drawgear pivotably articulated to the bearing block in a horizontal plane to absorb tractive and compressive forces transmitted through the coupling rod to the bearing block.

The invention is however not limited to a drawgear—the bearing block according to the invention is in fact also suited to the articulating of a coupling rod, for example by way of a joint bearing, without a drawgear being utilized thereto in the linkage.

In one preferential realization of the coupling linkage, the drawgear is realized as a spring device or spring mechanism comprising a push/pull rod connected or connectable to a car body-side end region of the coupling rod, at least one spring element preferably in the form of an annular spring element of elastomer material, and a housing open to the coupling rod, wherein the housing accommodates the at least one spring element. The at least one spring element can be of two-piece design so as to facilitate mounting to the push/pull rod. It is hereby conceivable for a first part of the spring element to be set onto the push/pull rod from a first side of the push/pull rod while the second part of the spring element is set onto the push/pull rod from the second side of the push/pull rod and then connected to the first part. It is in principle however also conceivable for the spring element to slide onto the drawgear longitudinally and be fixed in position there, for example by means of a nut.

The invention is however not limited to a coupling linkage in which the drawgear is realized as a spring device or spring mechanism. Different, preferably regeneratively designed damping means are in fact also applicable for the drawgear such as e.g. gas-hydraulic buffers or other such similar spring elements.

The housing of the drawgear implemented for example as a spring device or spring mechanism is preferably articulated to the bearing block so as to be pivotable in a horizontal plane by means of a first pivot pin in the mount of the first bearing shell and a second pivot pin in the mount of the second bearing shell. In such a drawgear, pretensioned resilient rings of an elastic material are advantageously provided within the inner circumferential surface of the housing, sequentially disposed with their central planes aligned vertically and spaced apart from one another in the longitudinal direction of the push/pull rod. It is hereby however also conceivable to make use of one single cylindrical elastomer element (elastomer cylinder) in place of multiple individual sequentially disposed rings. For example, annular circumferential elastomer beads can be provided on the outer circumferential surface of this cylindrical elastomer element.

In one possible realization of the drawgear implemented as an elastomer spring mechanism, both the rear; i.e. the car body-side end of the coupling rod or the push/pull rod respectively, as well as the inner surface of the housing exhibit circumferential annular beads directed toward one another, wherein the resilient rings made from elastic material, respectively said elastomer cylinder with the annular beads, are respectively held in spaces between two adjacent annular beads opposite the rear end of the coupling rod and the housing. Each elastic ring thereby directly abuts both the circumferential surface of the coupling shaft as well as the inner circumferential surface of the housing, whereby in the unloaded state of the elastomer spring mechanism with respect to tractive and compressive forces, the annular beads of the coupling rod align with the associated annular beads of the housing.

As indicated above, it is preferably provided for the housing of the drawgear realized as an elastomer spring mechanism to be articulated to the bearing block so as to be horizontally pivotably by means of the previously cited pivot pins in the mounts of the corresponding bearing shells. The first and/or second pivot pin is/are preferably configured as a shearing element such that the respective pivot pin shears off upon a critical impact force being transmitted from the coupling rod to the bearing block and thus disengaging the connection between the housing of the elastomer spring mechanism and the bearing block. In other words, in this preferential realization of the inventive coupling linkage, the housing of the elastomer spring mechanism is connected to the bearing block by means of at least one shearing element so that upon a defined critical impact force being exceeded, the coupling rod along with the housing and the elastic spring mechanism provided therein will be removed from the flow of force transmitted to the bearing block.

On the other hand, however, it is also conceivable for the first and/or second pivot pin to be connected to the drawgear housing by means of at least one shearing element, particularly a shear bolt, such that the at least one shearing element shears off upon a critical impact force being transmitted from the coupling rod to the bearing block, thus disengaging the connection between the drawgear housing and the bearing block.

It is hereby to be pointed out that this embodiment is of course not only limited to elastomer spring mechanisms but is also applicable to other drawgears integrated into the linkage. For example, such a drawgear can also be realized with hollow rubber springs, friction springs, hydraulic mechanisms or combinations thereof. Employing destructive impact elements additionally or alternatively to such regenerative impact elements is also conceivable.

A further advantage of the latter embodiment of the inventive coupling linkage is that after the critical impact force is exceeded, not only is the drawgear (elastomer spring mechanism) removed from the flow of force by the disengaging of the connection between the housing of the drawgear (elastomer spring mechanism) and the bearing block, but the coupling rod connected thereto is also removed from the force flow so that the bearing block remains in its original position on the railcar body. In particular, the entire bearing block is thereby for example no longer displaced into an area provided for the purpose in the undercarriage of the car body upon a crash, as is to some extent the case with conventional central buffer couplings. Instead, the bearing block remains on the car body and can assume the function of a "guide profile" and/or "catch element" with respect to the coupling shaft disengaging from the bearing block since the drawgear (elastomer spring mechanism) can be supported with the coupling shaft in or at the opening extending through the bearing block, thus preventing the disengaged coupling shaft or disengaged drawgear from falling onto the track (track bed).

It is particularly preferentially provided in the inventive coupling linkage employing a drawgear articulated on the bearing block so as to be pivotable in the horizontal plane for the drawgear to be realized such that the tractive and impact forces transmitted through the coupling rod to the drawgear are dampened by the regenerative deformation of the spring elements provided in the drawgear up to a defined magnitude, wherein said defined magnitude is fixed at a value which is lower than the response force of the at least one shearing element by which the drawgear can be pivotably connected to the bearing block in a horizontal plane. What this thereby achieves is the drawgear being able to absorb tractive and compressive forces up to the defined magnitude and thus absorb, and thereby eliminate, lesser impacts and vibrations, such as those which occur for example during travel or upon braking.

Forces of greater magnitude which occur for instance upon the vehicle colliding with an obstacle (crash), cause the at least one shearing element used to connect the drawgear to the bearing block to respond, whereby the connection between the drawgear and the bearing block disengages and the drawgear as well as the coupling rod are at least partly removed from the flow of force transmitted to the bearing block. Doing so thus allows the residual energy remaining after the damping capacity of the spring elements provided in the drawgear having been exhausted to be for example transferred to railcar body-side energy absorption elements such as for instance friction elements or crash boxes. The advantage herein is being able to achieve the greatest possible energy absorption calculable in a foreseeable sequence of events upon a crash since the coupling shaft with the central buffer coupling is removed from the force flow upon a defined level of force being exceeded, thus allowing the collision of the car bodies and the operation of the car body-side energy absorption elements.

One preferential realization of the solution according to the invention provides for the housing of the drawgear, which is articulated to the bearing block of the railcar body so as to be horizontally pivotable, for example by means of the at least one shearing element, to consist of two half-shells able to be detachably connected to one another. Threaded bolts are for example conceivable in this context for the connection. Connecting not just two but a plurality of housing parts is however of course also conceivable. Doing so facilitates fitting the spring elements in the drawgear.

The following will reference the accompanying drawings in describing the invention in greater detail.

Figure 4A:
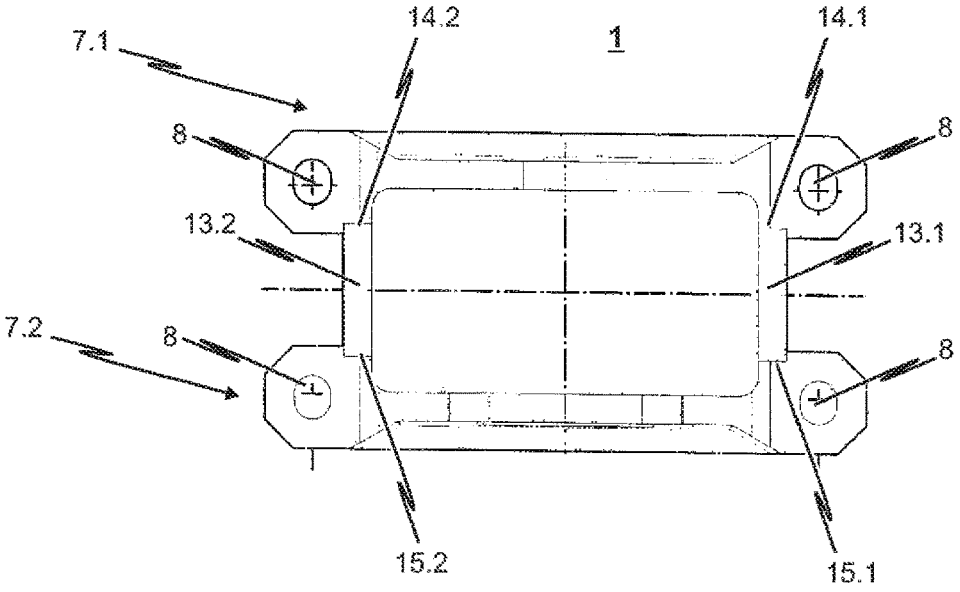
Figure 4B:
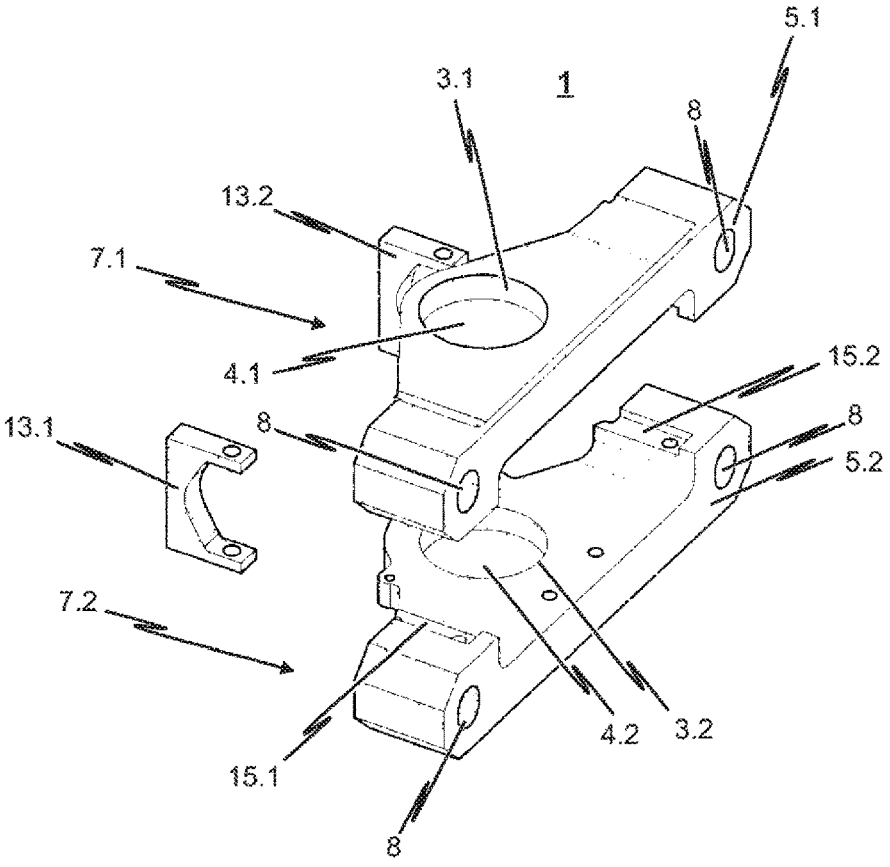

Shown are:

FIG. 1 a perspective view of a known prior art coupling linkage for a central buffer coupling of a track-guided vehicle, particularly a railway vehicle;

FIG. 2 a side sectional view of the coupling linkage according to FIG. 1;

FIG. 3*a-e* perspective views of different example embodiments of the bearing block according to the invention;

FIG. 4*a* a plan view of a further example embodiment of the bearing block according to the invention; and FIG. 4*b* a perspective exploded view of the example embodiment according to FIG. 4*a*.

FIGS. 1 and 2 depict a known prior art coupling linkage 150. The coupling linkage 150 consists of a bearing block 101 as well as a drawgear 50 articulated to the bearing block 101 so as to be pivotable in a horizontal plane and realized here in the form of an elastomer spring mechanism. The coupling linkage 150 serves to articulate a coupling rod of a central buffer coupling (not shown in FIGS. 1 and 2) to a railcar body (likewise not shown in FIGS. 1 and 2) so as to be pivotable in a horizontal plane.

As previously indicated, the linkage is realized by means of the drawgear 50 realized in the form of an elastomer spring mechanism. To this end, the drawgear 50 comprises a push/pull rod 51 which is either connectable to the railcar body-side end region of a (not shown) coupling rod or which forms the railcar body-side end region of the coupling rod.

As can be noted from the representation provided in FIG. 2, the drawgear 50 realized as an elastomer spring mechanism has a total of three spring elements 52.1 to 52.3. These spring elements 52.1 to 52.3 are each realized in the depicted embodiment as two half-rings of an elastic material. In the assembled state, the respective half-rings of each spring element 52.1 to 52.3 both receive the push/pull rod 51. The elastomer spring elements 52.1 to 52.3 are aligned vertically relative their central planes and are disposed and fixed at a distance from each other one behind the other in the longitudinal direction of the push/pull rod 51.

The drawgear 50 employed in the coupling linkage 150 according to FIGS. 1 and 2 exhibits a housing 53 open to the coupling rod in which the railcar body-side end region of the push/pull rod 51 projects coaxially at a radial distance from the inner circumferential surface of the housing 53. The inner surface of the housing 53 comprises circumferential annular beads, wherein the annular elastomer spring elements 52.1 to 52.3 are held between two adjacent annular beads vis-á-vis the car body-side ends of the push/pull rod 51 and the housing 53. Each elastomer spring element 52.1 to 52.3 thereby abuts both the circumferential surface of the push/pull rod 51 as well as the inner circumferential surface of the housing 53. In an unloaded state of the drawgear 50 with respect to tractive and impact forces (see FIG. 2), the elastomer spring elements 52.1 to 52.3 align with the respective annular beads of the housing 53.

As indicated above, the drawgear 50 is articulated to the bearing block 101 so as to be pivotable in a horizontal plane. To this end, the bearing block 101 comprises a bearing consisting of a first (upper) bearing shell 131 and a second (lower) bearing shell 132. The housing 53 of the drawgear 50 is configured with respective pivot pins 54.1, 54.2 accommodated by the respective bearing shells 131, 132 such that the housing 53 of the drawgear 50 and thus the entire drawgear 50 with the push/pull rod 51 and a coupling rod fixed or fixable to said push/pull rod 51 can be pivoted in a horizontal plane relative to the bearing block 101.

To be noted from the representations provided in FIGS. 1 and 2 is that the bearing block 101 employed in this conventional coupling linkage 150 exhibits a cage/housing structure 110 by means of which the bearing shells 131, 132 of the bearing are connected to a vertically extending flange 102. In particular, the flange 102 of the conventional embodiment of bearing block 101 is not situated in the same vertical plane through which the axis of rotation R defined by the bearing shells 131, 132 runs. Instead, the vertical flange plane A1 is spaced at a distance toward the car body from the vertical axis of rotation R defined by the bearing shells 131, 132 (see FIG. 2).

The flange 102 exhibits a first as well as a second flange region 121, 122, wherein each of the two flange regions 121, 122 is provided with holes 109 in which screws can be received in order to fix the bearing block 101 to the front end of a railcar body or to the undercarriage of a railcar body via flange regions 121, 122. The flange regions 121, 122 are thereby connected to the bearing shells 131, 132 by means of the cage/housing structure 110.

As can be noted particularly from the representation provided in FIG. 2, it is necessary in the conventional solution for the vertical flange plane A1 to be horizontally distanced from the vertical axis of rotation R defined by the bearing shells 131, 132. This distance is necessary in the conventional coupling linkage 150 so that the drawgear 50 accommodated in the housing 53 can move toward the car body relative to the bearing block 101 upon compressive load in order to thereby be able to regeneratively absorb compressive forces. The horizontal spacing of the vertical flange plane A1 is thereby dictated by the vertical axis of rotation R, and thus the length of the cage/housing structure 110 by the overall length and the damping behavior of the drawgear 50.

It is particularly evident that the cage/housing structure 110 of the bearing block 101 needs to be realized as a function of the damping characteristic and the overall length of the drawgear 50 accommodated in the bearing block 101. If, for example, a drawgear 50 having more than three spring elements 52.1 to 52.32 is to be used, the housing 53 of the drawgear 50 is lengthened so that a greater horizontal distance is provided between the vertical axis of rotation R defined by the bearing shells 131, 132 and vertical flange plane A1.

As a result, the bearing block 101 employed in the coupling linkage 150 depicted in FIGS. 1 and 2 is only suitable for the specific drawgear 50 depicted in these figures.

The following will reference the depictions provided in FIGS. 3*a* to 3*e* and 4 in describing various different embodiments of the inventive bearing block 1 in greater detail.

Common to all the embodiments of the inventive bearing block 1 is that—in contrast to the conventional solutions—the bearing block 1 is realized in a modular design. "Modular" in this context means there is no unilateral configuration of the bearing block 1 as a cast or forged part; instead the supporting and bearing parts of a push/pull rod 51 or respectively a drawgear 50 (not shown in FIGS. 3*a* to 3*e*) are realized separately from one another.

To this end, the bearing block 1 according to the invention comprises a first (upper) crosspiece 7.1 as well as a second (lower) crosspiece 7.2 formed separately therefrom. Each crosspiece 7.1, 7.2 is preferably of symmetrical design with respect to a vertical axis of reflection and comprises a respective bearing shell 3.1, 3.2. The bearing shells 3.1, 3.2 each comprise a mount 4.1, 4.2 for receiving a common pivot bolt (not shown), which extends vertically and is situated in the previously cited vertical plane of symmetry. On the other hand, the mounts 4.1, 4.2 are also designed such that they can also receive a pivot pin 54.1, 54.2 allocated to the respective bearing shell 3.1, 3.2. In one preferential realization, the mounts 4.1, 4.2 are realized as passage openings.

The example embodiments of the inventive bearing block 1 according to the depictions of FIGS. 3*a* to 3*e* each comprise a baseplate 2 implemented as a separate component serving as a flange by means of which the two crosspieces 7.1, 7.2 can be connected to the railcar body or to the undercarriage of a railcar body respectively. In this respect, the baseplate 2 defines the vertical flange plane of the bearing block 1.

The baseplate 2 according to the depicted example embodiments of the inventive bearing block 1 exhibits a centrally arranged opening 6 through which a drawgear 50 (not shown in FIG. 3) supported by the bearing block 1 can be pushed in the event of a crash. It would hereto be necessary for the drawgear 50 to be detachably connected to the two crosspieces 7.1, 7.2 such that the connection to the crosspieces 7.1, 7.2 disengages upon a critical impact force being exceeded.

Flange regions 2.1, 2.2 connected together by means of transverse (horizontally extending) connecting bridges 3 are realized on both sides of the opening 6 formed in the baseplate 2. Each connecting bridge 3 is preferably situated in a horizontal plane in which the bearing shells 3.1, 3.2 of the first or respectively second crosspiece 7.1, 7.2 are also situated. The bilateral flange regions 2.1, 2.2 thereby serve in the connecting to the front end of a railcar body or to the front end of a railcar body undercarriage respectively, preferably by means of a screw connection. To this end, corresponding drill holes 9 are provided in the two flange regions 2.1, 2.2 which can receive respective cylindrical connector elements, particularly screw, bolt or pin connector elements.

The two crosspieces 7.1, 7.2 of the example embodiments of the inventive bearing block 1 are configured with two lateral flange regions 5.1, 5.2 in which a respective drill hole 8 is formed for receiving a cylindrical connector element, particularly a screw, bolt or pin connector element.

The horizontal spacing of the drill holes 8 in the respective flange regions 5.1, 5.2 of the crosspieces 7.1, 7.2 is selected such that the sectional drilling pattern of each crosspiece 7.1, 7.2 at least partly coincides with the drilling pattern of the drill holes 9 provided in the flange regions 2.1, 2.2 of the baseplate 2. By so doing, it is possible for a cylindrical connector element, particularly a screw, bolt or pin connector element, to extend through the aligning drill holes 8, 9. This connector element can preferably further serve in forming a (releasable) connection to the front end of the respective railcar body or respective railcar body undercarriage.

So that the inventive bearing block 1 consisting—as stated above—of the modular "first crosspiece 7.1," "second crosspiece 7.2" and preferably "baseplate 2" components, can be pre-assembled, additional drill holes 10, 11 are provided in the baseplate 2 and in the crosspieces 7.1, 7.2 so that the crosspieces 7.1, 7.2 can be connected to the baseplate 2 by means of screws 12.

Evident from an integrated view of the modularly constructed bearing blocks 1 according to the depictions of FIGS. 3*a* to 3*e* is that the respective crosspieces 7.1, 7.2 can be connected to differently dimensioned baseplates 2. It is thus in particular possible for crosspieces 7.1, 7.2 of the same design to be able to form a bearing block 1 configured for drawgears of differing heights. To this end, the respective baseplate 2, and the dimensioned height of the baseplate 2 in particular, is to be adapted accordingly.

On the other hand, a defined baseplate 2 is also suited to forming differing bearing blocks since the baseplate 2 is able to connect crosspieces 7.1, 7.2 of different design. It is thus conceivable for one and the same baseplate to be able to realize bearing blocks 1 having vertical axes of rotation at different distances from the vertical flange plane defined by the baseplate 2.

The following will reference the representations in FIGS. 4*a* and 4*b* in describing a further example embodiment of the bearing block 1 according to the invention. Specifically, FIG. 4*a* shows a plan view of the example embodiment in the fully assembled state of the bearing block 1 while FIG. 4*b* shows a perspective exploded view of the bearing block 1 according to FIG. 4*a*.

The further embodiment of the inventive bearing block 1 depicted in FIGS. 4*a* and 4*b* consists—as in the case of the previously described embodiments referencing the FIG. 3*a-e* depictions—of two separately configured crosspieces 7.1, 7.2 which are structurally and functionally comparable to the previously described crosspieces in the embodiments according to the depictions in FIGS. 3*a* to 3*e*. Consequently, a more detailed description of the crosspieces 7.1, 7.2 employed in the further example embodiment will be omitted at this point.

The further example embodiment of the inventive bearing block 1 according to the FIGS. 4*a* and 4*b* depictions substantially differs from the previous example embodiments in that the two crosspieces 7.1, 7.2 are not connected together by means of a baseplate 2. In place of a baseplate, laterally arranged spacers 13.1, 13.2 are instead employed in the further example embodiment. As can be noted particularly from the perspective exploded view according to FIG. 4*b*, in one realization of the inventive solution, these spacers 13.1, 13.2 can be realized as substantially U-shaped pieces, in particular separately from the two crosspieces 7.1, 7.2.

In the further embodiment of the inventive bearing block 1 depicted in FIGS. 4*a* and 4*b*, the spacers 13.1, 13.2 are designed with two substantially horizontally extending leg portions and one vertical connecting bridge. The spacers 13.1, 13.2 are detachably connected to the two crosspieces 7.1, 7.2 such that in the assembled state (see FIG. 4*a*), the spacers 13.1, 13.2 define the vertical spacing between the two crosspieces 7.1, 7.2.

As can be noted particularly from the perspective exploded view according to FIG. 4*b*, the horizontally extending regions of the respective spacers 13.2, 13.2 can be set into mounts 14.1, 14.2, or 15.1, 15.2 respectively, which are preferably formed at the respective lateral edge regions of the two crosspieces 7.1, 7.2. Particularly applicable as mounts 14.1, 14.2/15.1, 15.2 are recesses or channel-like hollows in the crosspieces 7.1, 7.2, although other embodiments are of course also conceivable hereto. The provision of such mounts 14.1, 14./15.1, 15.2 defines the bearing and the position of the spacers 13.1, 13.2 relative to the two crosspieces 7.1, 7.2.

The preferably detachable connection between the spacers 13.1, 13.2 and the respective crosspieces 7.1, 7.2 is effected in the depicted embodiment by means of a screw connection. However, the invention is not limited to the spacers 13.1, 13.2 being detachably connected to the crosspieces 7.1, 7.2; a permanent connection, e.g. a welded connection, is in fact also conceivable.

Particularly evident from the FIG. 4*a* depiction is that the vertical extension of the spacers 13.1, 13.2 ultimately defines the distance between the first horizontal plane, in which the bearing shell 3.1 of the first crosspiece 7.1 lies, and the second horizontal plane, in which the bearing shell 3.2 of the second crosspiece 7.2 lies. As a result, the vertical spacing between the crosspieces 7.1, 7.2 can be adjusted to any desired position by the appropriate selection of the spacers 13.1, 13.2.

To thus be noted at this point is that different variants of the bearing block 1 can be easily and cost-effectively realized since only a limited number of crosspieces 7.1, 7.2 of different design and a limited number of baseplates 2 of different design, or a limited number of spacers 13.1, 13.2 of different design respectively, need to be provided in order to be able to realize a plurality of differently designed bearing blocks 1.

The present invention is not limited to the example embodiments depicted in the drawings but rather yields from an integrated consideration of all the features disclosed herein in context.

REFERENCE NUMERALS

1 bearing block
2 baseplate
2.1 first flange region
2.2 second flange region
3 connecting bridge
3.1 first bearing shell
3.2 second bearing shell
4.1 mount in first bearing shell (bearing shell opening)
4.2 mount in second bearing shell (bearing shell opening)
5.1, 5.2 flange region (of crosspiece)
6 opening in baseplate
7.1, 7.2 crosspiece
8 drill hole (in crosspiece)
9 drill hole (in flange region 2.1, 2.2)
10 drill hole (in baseplate)
11 drill hole (in crosspiece)
12 screw
13.1, 13.2 spacer
14.1, 14.2 mount in first crosspiece
15.1, 15.2 mount in second crosspiece
50 drawgear (elastomer spring mechanism)

51 push/pull rod
52.1 to 52.n elastomer spring element
53 drawgear housing
53.1, 53.2 half-shell of housing 53
54.1, 54.2 pivot pin
101 bearing block (prior art)
102 flange (prior art)
109 mounting hole (prior art)
110 cage/housing structure (prior art)
121 first flange region (prior art)
122 second flange region (prior art)
131 first bearing shell (prior art)
132 second bearing shell (prior art)
141 pivot pin (prior art)
142 pivot pin (prior art)
150 coupling linkage
R axis of rotation
A1 vertical flange plane

What is claimed is:

1. A bearing block for articulating a coupling rod to a car body of a track-guided vehicle, wherein the bearing block comprises the following:

a first crosspiece having a first bearing shell situated in a first horizontal plane; and a second crosspiece having a second bearing shell situated in a second horizontal plane distanced from the first horizontal plane, wherein the first and second bearing shells each have a respective mount for a common vertically extending pivot bolt or for a pivot pin allocated to the first and second bearing shells, characterized in that the first and second crosspieces are implemented as separate structural components independently connectable to the car body of the track-guided vehicle.

2. The bearing block according to claim 1, wherein the bearing block further comprises a baseplate arranged in a vertical flange plane and having at least one flange region connectable to the car body of the track-guided vehicle, wherein the baseplate is configured as a separate component from the first and second crosspieces.

3. The bearing block according to claim 2, wherein the first and second crosspieces are detachably connectable to the baseplate, and thus by means of the baseplate to the car body, independently of one another.

4. The bearing block according to claim 2, wherein the baseplate comprises a first flange region connectable to the car body and a second flange region horizontally distanced therefrom via which the baseplate is connectable to said car body, wherein the first and second flange regions are connected to one another by means of at least one horizontally extending connecting bridge.

5. The bearing block according to claim 4, wherein the at least one horizontally extending connecting bridge is situated in a horizontal plane in which the first and second bearing shells of the first or second crosspieces are also situated.

6. The bearing block according to claim 1, wherein at least one of the first and second crosspieces is provided with a separately configured spacer for detachably connecting the first and second crosspieces so as to vertically distance them from one another.

7. The bearing block according to claim 6, wherein at least one of the first and second crosspieces comprises a mount at a lateral edge region thereof for receiving an area of the at least one spacer.

8. The bearing block according to claim 6, wherein two spacers are provided which are spaced apart from each other horizontally and their vertical extension defining a distance between the first horizontal plane, in which the first bearing shell of the first crosspiece is situated, and the second horizontal plane, in which the second bearing shell of the second crosspiece is situated.

9. The bearing block according to claim 1, wherein the first and second crosspieces have respective drill holes for receiving cylindrical connector elements in forming a detachable connection to at least one of the baseplate and the car body of the track-guided vehicle.

10. The bearing block according to claim 9, wherein the detachable connection is a screw, bolt or pin connection.

11. The bearing block according to claim 9, wherein the baseplate comprises drill holes for receiving the cylindrical connector elements in forming the detachable connection of the crosspieces to the baseplate, wherein a drilling pattern of the baseplate at least partly coincides with the drilling pattern of the first and second crosspiece.

12. The bearing block according to claim 1, wherein the first and second crosspieces are formed as a forged construction.

13. The bearing block according to claim 1, wherein the mounts of the first and second bearing shells define a common vertical axis of rotation for a drawgear able to be accommodated in the bearing block so as to be pivotable in a horizontal plane.

14. A coupling linkage for an articulated connecting of a coupling rod to a car body, wherein the coupling linkage comprises the following:

a bearing block including a first crosspiece and a second crosspiece implemented as separate structural components independently connectable to the car body of the track-guided vehicle, wherein the first crosspiece and the second crosspiece that form the bearing block are adjustable and configured to house drawgears of different heights; and a drawgear detachably connected to the first crosspiece and the second crosspiece, the drawgear pivotably articulated to the bearing block in a horizontal plane for absorbing tractive and compressive forces transmitted through the coupling rod to the bearing block.

15. The coupling linkage according to claim 14, wherein the drawgear is designed as a spring mechanism and comprises the following:

a push/pull rod connected or connectable to a car body-side end region of the coupling rod;

at least one damping element, in the form of a spring element connected to the push/pull rod or integrated into the push/pull rod; and a housing open to the coupling rod in which the at least one damping element is accommodated, wherein the housing is articulated to the bearing block so as to be pivotable in a horizontal plane by means of a first pivot pin in a mount of the first bearing shell and by means of a second pivot pin in a mount of the second bearing shell.

16. The coupling linkage according to claim 15, wherein at least one of the first and second pivot pins are configured as a shearing element such that the respective pivot pin shears off upon a critical impact force being transmitted from the coupling rod to the bearing block and thus disengaging a connection between the housing of the drawgear and the bearing block.

17. The coupling linkage according to claim 15, wherein at least one of the first and second pivot pins are connected to the housing of the drawgear by means of at least one shearing element such that the at least one shearing element shears off upon a critical impact force being transmitted from the coupling rod to the bearing block, and thus disengaging a connection between the housing of the drawgear and the bearing block.

18. The coupling linkage according to claim 14, wherein the first crosspiece and the second crosspiece are each configured with two lateral flange regions in which a respective drill hole is formed for receiving a cylindrical connector element.

19. The bearing block according to claim 3, wherein the baseplate comprises a first flange region connectable to the car body and a second flange region horizontally distanced therefrom via which the baseplate is connectable to said car body, wherein the first and second flange regions are connected to one another by means of at least one horizontally extending connecting bridge.

20. The bearing block according to claim 2, wherein at least one of the first and second crosspieces is provided with a separately configured spacer for detachably connecting the first and second crosspieces so as to vertically distance them from one another.

* * * * *